US006409550B1

(12) United States Patent
Splichal et al.

(10) Patent No.: US 6,409,550 B1
(45) Date of Patent: Jun. 25, 2002

(54) PLANAR BLIND-MATE CONNECTORS

(75) Inventors: Jiri Splichal, Silver Spring; Jimmy Fredoon Dholoo, Gaithersburg, both of MD (US)

(73) Assignee: MCE/Weinschel Corporation, Frederick, MD (US)

( * ) Notice: Subject to any disclaimer, the term of this patent is extended or adjusted under 35 U.S.C. 154(b) by 0 days.

(21) Appl. No.: 09/440,099

(22) Filed: Nov. 15, 1999

(51) Int. Cl.[7] ..... H01R 13/502
(52) U.S. Cl. ..... 439/701; 439/289; 439/349
(58) Field of Search ..... 439/701, 289, 439/349, 347, 318–322, 63, 824, 247

(56) References Cited

U.S. PATENT DOCUMENTS

| | | | | | |
|---|---|---|---|---|---|
| 4,358,174 | A | * | 11/1982 | Dreyer | 339/64 |
| 4,445,743 | A | * | 5/1984 | Bakker | 339/90 |
| 4,645,288 | A | * | 2/1987 | Stursa | 339/177 |
| 4,914,061 | A | * | 4/1990 | Williams | 439/349 |
| 4,995,815 | A | * | 2/1991 | Buchanan et al. | 439/63 |
| 5,021,001 | A | * | 6/1991 | Ramirez | 439/349 |

* cited by examiner

*Primary Examiner*—P. Austin Bradley
*Assistant Examiner*—Alexander Gilman
(74) *Attorney, Agent, or Firm*—Howard L. Rose; Thomas C. Steidel

(57) ABSTRACT

A planar connector is constructed to permit large numbers of two part connectors to be ganged for concurrent interconnection with virtually no cross talk between adjacent connectors and minimal damage due to misalignment of the large number in the array that are concurrently connected. Cross talk is minimized by having contact of the connector elements occur in shielded regions or below the plane of contact of the opposing contact members while the engaging members are planar mating interfaces at the point of engagement, thus materially reducing wear relative to a pin and socket type contact. This feature allows these planar blind-mate connectors to operate over one hundred thousand mating cycles. Contact with antennas and printed circuits is provided, and floating inner and outer contacts provide a superior long life rotary joint providing excellent r.f. performance. The connector body is held in a support and remains stationary in said support in the presence of movement of the planar contacts.

4 Claims, 8 Drawing Sheets

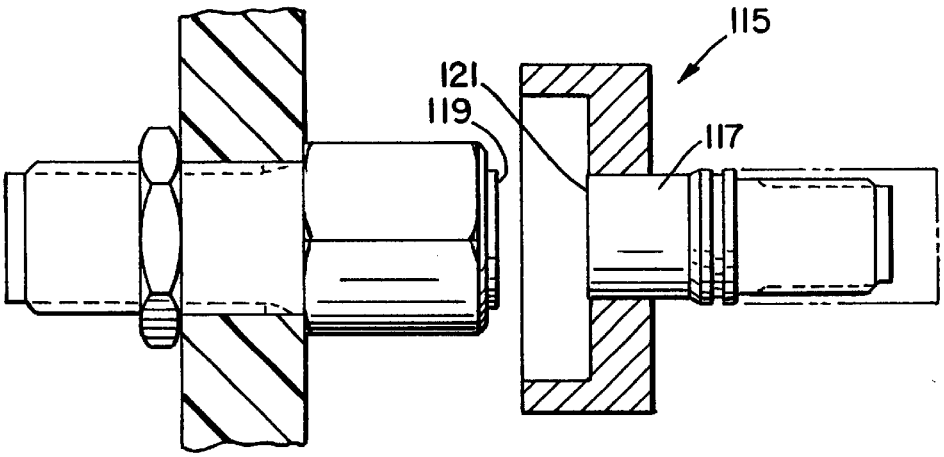
Fig.10A
Fig.11
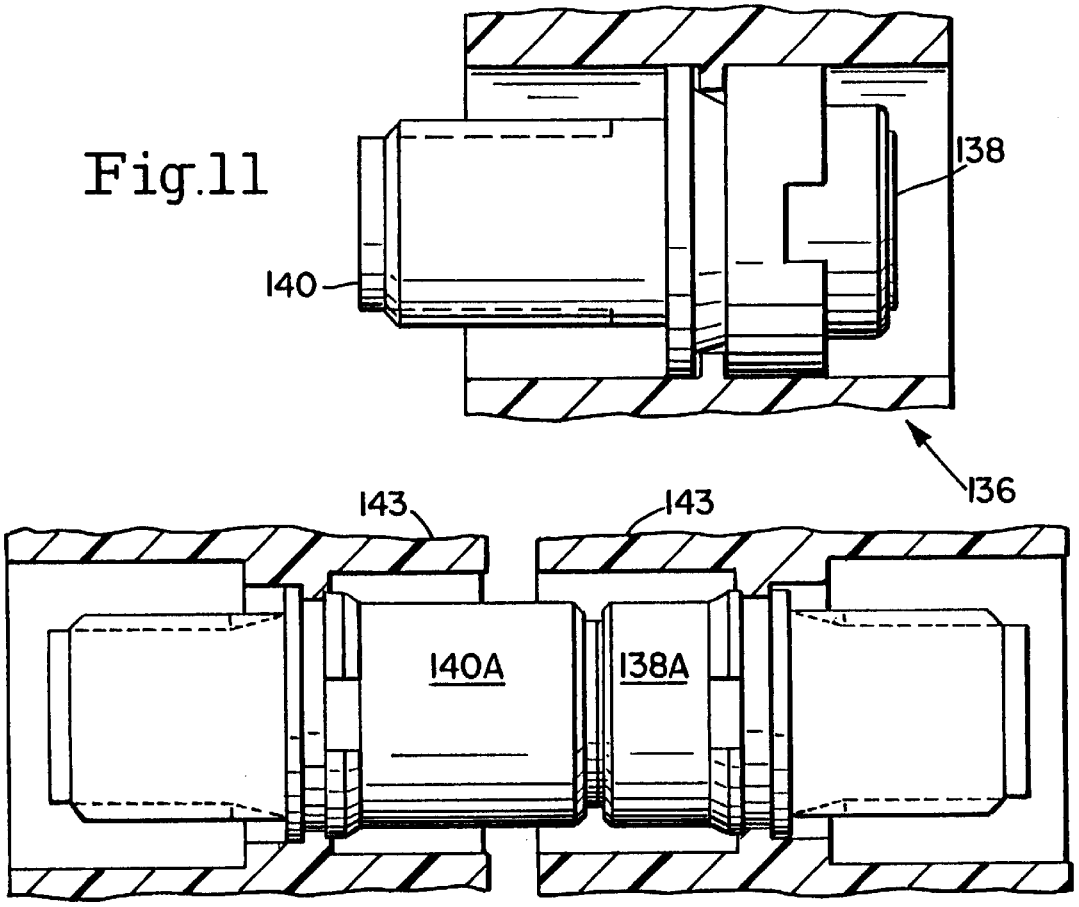
Fig.11A

PLANAR BLIND-MATE CONNECTORS

FIELD OF THE INVENTION

The present invention relates to planar connectors, and more specifically to ganged planar connectors that may be used as a single connector set or ganged so as to mate concurrently on a one for one basis.

BACKGROUND OF THE INVENTION

The assignee of the present invention is the owner of record of two patents on planar crown connectors, U.S. Pat. Nos. 4,836,801 and 5,021,001 whose interface can be used in planar blind-mate connectors. A two part connector of the present invention consists of two metal bodies containing two planar interfaces as the electrical contacts and integral aligning hardware to assure proper mating of the contacts.

It is the object of the present invention to provide planar blind-mate electrical connectors as single pairs or as ganged pairs of connectors in an array of connectors. In the ganged version of the present invention the two elements of the connectors are maintained in contact by the mechanism that brings the two elements together.

BRIEF DESCRIPTION OF THE PRESENT INVENTION

In accordance with the present invention, the major contact components of planar connectors of U.S. Pat. Nos. 4,836,801 and 5,021,001 have been employed in one or more pairs of connectors. The improvements provided by the present invention relate to concurrent proper mating of each connector pair so that the mating process brings two flat surfaces into contact, significantly reducing contact wear associated with the conventional pin and socket contact matings of elements. The mating process is thus achieved such that minimum pair wear occurs and very high r.f. frequencies can be achieved. Further the coupling can be achieved with excellent r.f. shielding and isolation between adjacent connector pairs, thus virtually eliminating cross talk.

In one embodiment a plurality of floating planar connectors are arrayed preferably in a metal or metalized frame while fixed connector modules or contacts are also carried preferably in a metal or metalized frame with the same array of and spacing between elements. In one embodiment the mating of the connector elements occurs inside a connector cavity, not at the mating surfaces of the modules. This arrangement insures there will be virtually no damage to the connector elements and provides additional electrical shielding between adjacent connectors. More specifically, the contacts of one array are spring biased toward the other set and one set of contacts are received below the mating surface of their modules. The mating contacts of one module may extend beyond their modules and into the recesses of the other frame on engagement, thus providing some r.f. shielding.

The axial float/movement of the contacts of the present invention occurs without any movement of the main body, i.e., the mechanism (spring biased inner and outer 'floating' contacts) that allows axial movement totally isolated from the connector body. This is a major embodiment because any cables, devices or components attached to the other (opposite) end of the connector will not be subject to any motion (when the two blind-mate interfaces come into contact) nor will they themselves subject the connector interface to any additional stresses or torques as would be the case if the connector body were not isolated from the moving contacts. (There are blind-mate connectors wherein the connector body itself is spring biased to allow for axial motion. In this case, say an array of ganged connectors with cables attached to the other end could by the mere weight of or bends in the cable add to the mating force of connector pairs or subject them to external stresses, torque, etc. Also, in such designs when mating between two blind-mates take place, the cable/device connected to the other end is forced to displace axially . . . not a desirable situation!

One of the said array of connectors may be carried on a slide having limited motion within its frame. Aligning pins extending from the slide mate with aligning holes in the other module to insure adequate alignment of the contacts. The term"adequate" is employed since in many of the situations in which these connectors are employed precise registration is not required. Thus, changes in temperature or other factors that can cause some misalignment of the contacts do not produce signal degradation or damage to the elements.

The individual connector elements may be press fitted or molded into the modules or held in the modules by snap rings, spring clips, or nuts to permit ready replacement of connectors.

As a result of the use of two generally planar contacting surfaces as opposed to pin insertion connectors, the force required to produce electrical contact is greatly reduced. Also wear associated with such connectors is significantly reduced; the mating life of the connector surfaces of the present structure being increased by a factor of at least 10. As a result, the modules may be lighter than those used in the pin insertion connectors, and misalignment is not as significant a factor as where a pin must be precisely aligned with a hole. In a ganged array of pin type connectors, very precise and therefore unduly expensive mounting hardware must be used.

Other features, objects and advantages of the present invention, together with the best means contemplated by the inventor thereof for carrying out the invention will become more apparent from reading the following description of a preferred embodiment and perusing the associated drawing in which:

BRIEF DESCRIPTION OF THE DRAWINGS

FIG. 10A illustrates an alternative r.f. shielding arrangement at the region of connection of two connectors.

FIG. 11 illustrates a recessed connector recessed in the module;

FIG. 11A illustrates a mated connector pair, with a fixed planar blind-mate connector at one end and a floating blind-mate connector at the other end, one connector being recessed to reduce cross talk between adjacent connector pairs;

DETAILED DESCRIPTION OF THE PRESENT INVENTION

Figure 1:
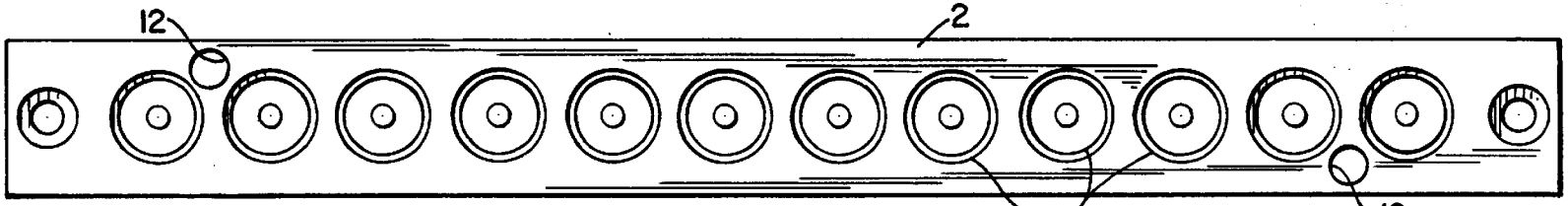
FIG. 1 is a top view of a first connector module with 12 fixed connectors arrayed therein.

Referring now specifically to FIG. 1 of the accompanying drawings, a module 2 has mounted therein twelve fixed planar blind-mate connectors 4 and has in the surface two alignment holes 12 located, for instance, between the two end contacts at each end of the frame. Although illustrated as having twelve members, five, ten and twelve member arrays are quite common, as are others.

Figure 2:
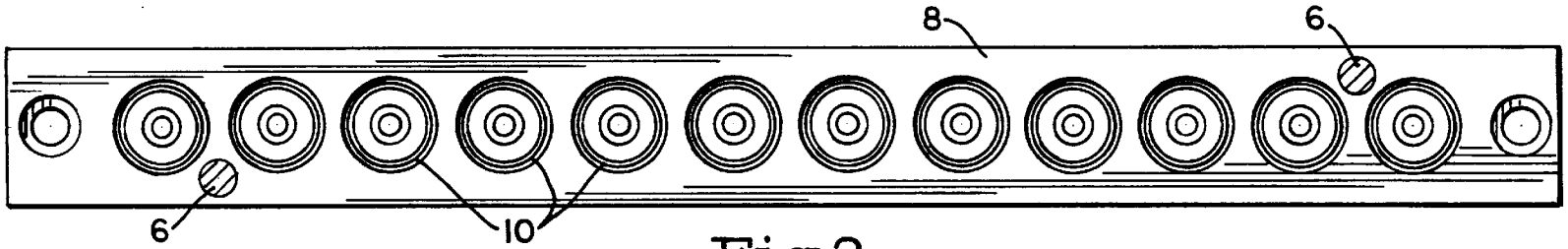
FIG. 2 is a top view of a second connector module with twelve floating contacts arrayed therein.
Figure 4:
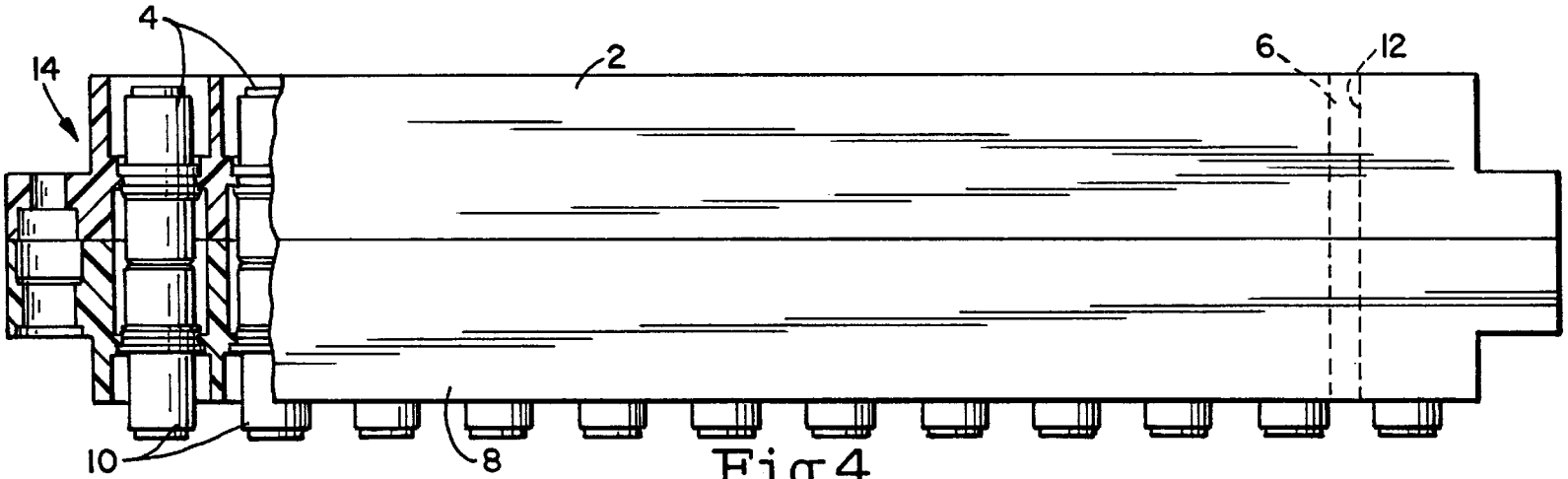
FIG. 4 illustrates contact between modules for mounting in corresponding frame members.

A module 8 carries the corresponding floating connectors 10 for mating with the fixed planar connectors in the other frame, FIG. 1. Mating of the connectors of FIGS. 1 and 2 is illustrated in FIG. 4. In this FIG. 4, floating connectors 10 of FIG. 2 are intended to mate with connectors 4 of FIG. 1. The module 8 of FIG. 2 has alignment pins 6 for mating with alignment holes 12 of module 2. The alignment pins insure proper mating of the connectors of the two modules. The various structures of the floating connectors are discussed below.

Figure 3:
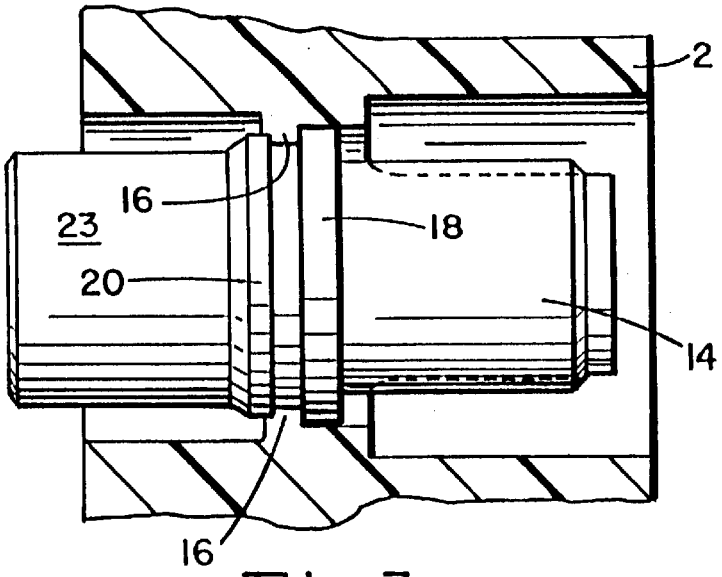
FIG. 3 is a detailed view of one structure for retaining a connector in a frame member.
Figure 5:
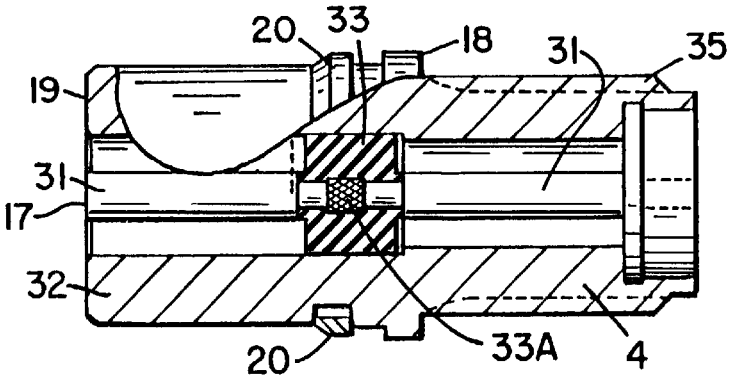
FIG. 5 illustrates a fixed blind-mate connector.
Figure 6:
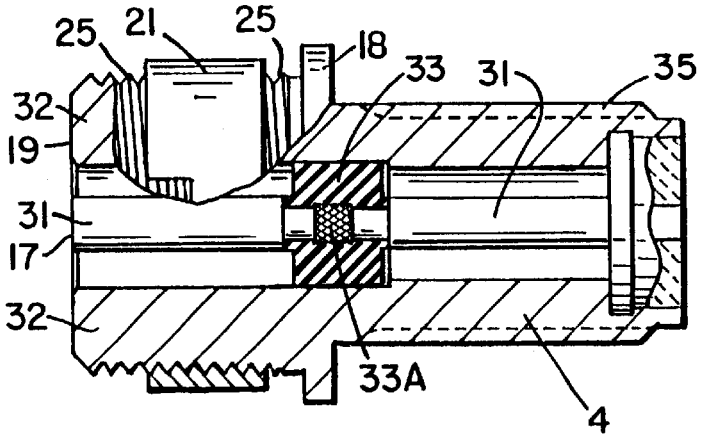
FIG. 6 illustrates another fixed blind-mate connector.

Referring now to FIGS. 3, 5 and 6, there are illustrated one arrangement of securing various connectors in a module. A connector element generally designated by reference numeral 14 may be snap fitted or press fitted into the module and positioned by an inwardly directed circular projection 16 that engages a shoulder 18 on the connector element. A snap ring 20 is pushed on over barrel 23 and encircles the body of the connector element. The ring engages the side of the projection 16 remote from shoulder 18 of the element.

The fixed blind-mate contact, as clearly illustrated in FIGS. 5 and 6, is of simple construction and consists essentially of a center rod 31 supported by an insulating plate 33 in a housing 32. The rod 31 is firmly held in the insulating plate 33 by a knurled region 33A of the rod. The left end of the rod 31 as viewed in FIG. 5 provides a planar center contact face 17 and a planar ground face 19 is provided at the left end of the housing 32. The ends of 17 and 19 are adapted to be contacted by the floating members of FIG. 2. The body 4 may be threaded at 35 at the right end of the body or otherwise provided with well known connecting means.

The fixed contact may be held in place against circular projection 16 of the module 2 by shoulder 18 on one side of element 16 and a snap ring 20 on the other side of element 16. In FIG. 6 a nut 21 on threads 32 of the body may be used in place of the ring 20.

The above arrangement is employed for securing the connectors in the mating modules and reference is made to FIG. 4. Mating modules 2 and 8 are locked together by appropriate means, such as bolts, to be described subsequently. It is to be noted that in FIG. 4 the connector element 4 extends into the module 8 to contact the connector 10, thus physically and electrically protecting the region of the interface between the two connectors. The introduction of one connector element into the other module significantly reduces cross-talk between adjacent connectors.

The use of snap rings, such as snap ring 20, see FIG. 3, to retain connector elements in the modules is only one of several ways this may be done, but is used for quick disconnect as explained below. A screw down ring or lock nut such as a lock nut 21, FIG. 6, that engages threads 25 formed in connector body 32 as illustrated in FIG. 6 may be used.

Figures 7, 8A, 8B:
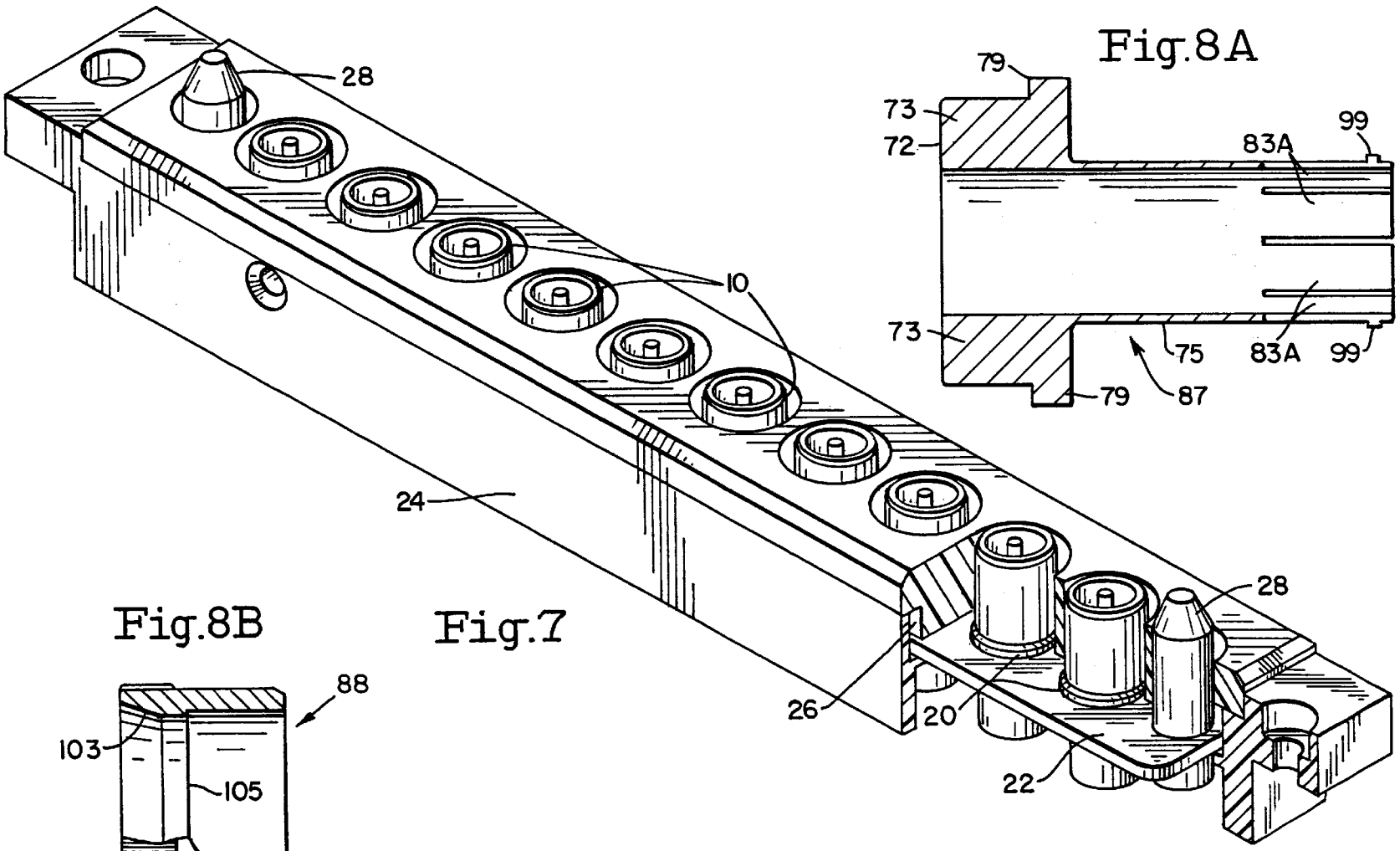
FIG. 7 illustrates a module for holding fixed or floating connectors with the contacts positioned on a slide having aligning pins.
FIG. 8A is a detailed view of the floating ground contact of a connector.
FIG. 8B is a detailed view of a ring employed to retain the floating ground contact.

The module and connector arrangement may provide for both lateral and vertical movement of at least one set of the connector elements as illustrated in FIG. 7. In this arrangement, the connectors 10 are carried on an insulating slide 22 that is translatable in a module 24. The slide 22 is positioned in a track 26 and carries aligning pins 28. Thus, when the modules are brought together pins 28 enter aligning holes in a mating module and shift the slide 22 to insure proper alignment of connector elements.

Figure 8:
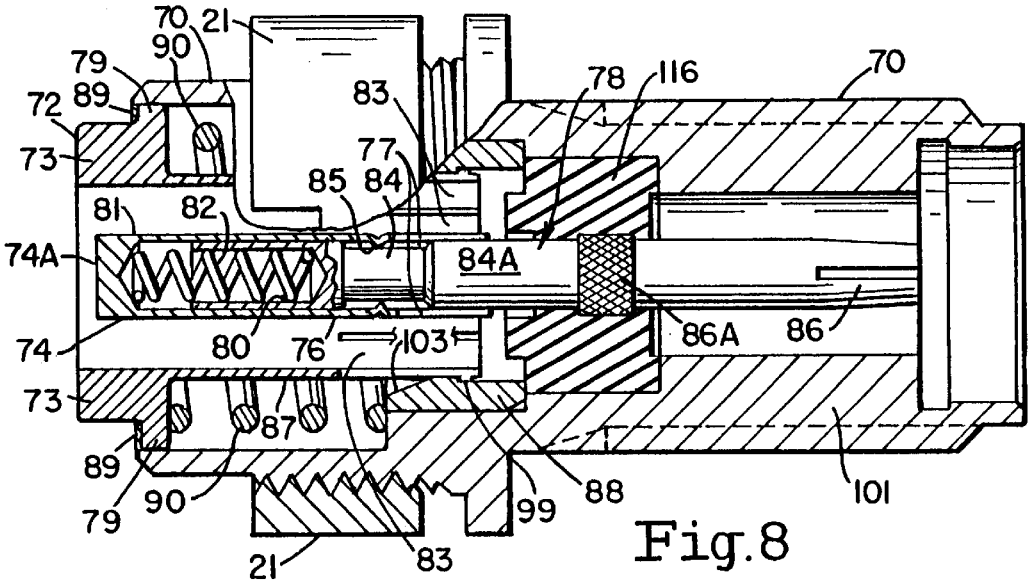
FIG. 8 illustrates in detail a floating blind-mate connector.

Referring now to FIG. 8 of the accompanying drawings, there is illustrated in detail a floating contact of the connector system. The inner and outer contacts of the outer body 70 are separately spring biased to insure good contact between the floating and fixed contacts. The body 70 has a spring biased ground contact 72 and a spring biased plunger 74 consisting of a generally planar contact surface 74A and a sleeve 76 that slides over a center contact 78. The center contact 78 includes the plunger 74 with outer sleeve 76 and with spring loaded fingers 77 providing a light wiping contact over the region 84. The light wiping contact provides good electrical contact with minimum wear and drag. As seen in FIG. 8, motion of the sleeve 76 and therefore plunger 74 is limited by dimples 85 that translate in the region 84 of reduced diameter and hold the plunger 74 captive. The dimples do not contact the region 84 so as to reduce drag on the plunger.

The center contact 78 has a center contact receptacle 80 for the biasing spring 82 that biases plunger 74 into engagement with a facing planar contact 17 of fixed contact 31, see FIGS. 5 and 6. The end of plunger 74 in FIG. 8 is planar to provide a planar surface in contact with the planar surface 17 of FIGS. 5 and 6.

The body 70 has a forward or left region as viewed in FIG. 8 located in the same region as plunger 74. Coaxially with the plunger 74 is outer contact 73 of member 87 slidable within the body 70. The contact 73 is spring biased by spring 90 and has a planar contact surface on its contact end. Thus, both contact surfaces, 17 and 19 (FIGS. 5 and 6) and 72 and 74A of FIG. 8 are planar, larger, and more substantial than coaxial pin and socket receiver contacts.

The member 87 of FIG. 8 is illustrated in greater detail in FIG. 8A. A left end of the member 87 as illustrated in FIG. 8A provides the planar contact surface 72 at the left end of region 73. The member 73 has an enlarged skirt 79 engaged by inwardly directed stakes 89 extending from the left end of the body 70. The stakes 89 engage the skirt 79 and limit the leftward movement of the grounded floating contact 87, thus holding it captive.

Sleeve 75, the outer contact ground member, extends rearwardly, (to the right as viewed in FIG. 8), and terminates for instance in 4 to 8 or more spring fingers 83 which in turn terminate, each, in short outwardly extending skirts 99.

Figure 10:
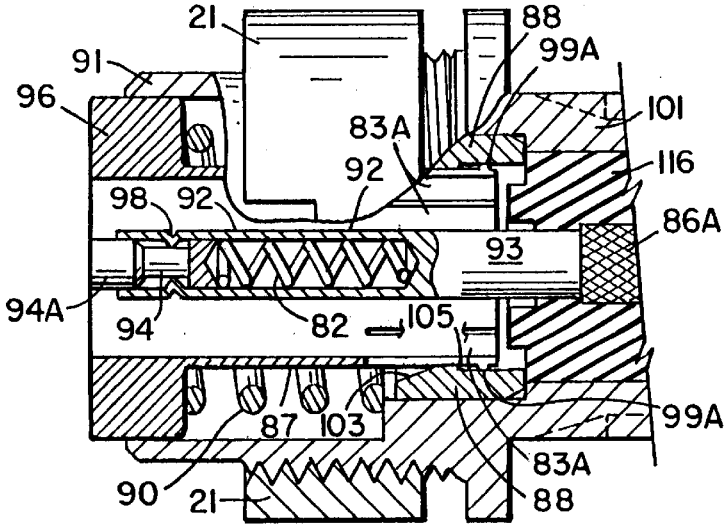
FIG. 10 illustrates an alternative construction of a floating blind-mate connector.

The member 73 may have two different configurations. Referring back to FIG. 8, in one configuration, as indicated above, inwardly directed stakes 89 extend from the left end of the connector body 70. In this arrangement the leftward most movement of the member 87 is restrained by engagement of stakes 89, with the enlarged region 79, thus providing captivation for the floating ground contact 87. In an alternative and preferred arrangement, the stakes 89 are eliminated as illustrated in FIG. 10.

The aforesaid construction of the floating connector body 70 as illustrated in FIG. 8 can degrade the standing wave ratio (SWR) due to changes in the relative diameters of the center and outer contacts at the same axial location. In the structure of FIG. 8, as the plunger 74 and the outer conductor 87 float/move outwards to the left, the ratio of the diameter of the outer contact to the inner contact increases in one specific region. Consequently, the impedance of the coaxial cavity in that same axial region is greater than the intended 50 ohm system impedance, producing the aforesaid (SWR) problem. The initial ratio of those two diameters, when the outer and inner contacts are fully retracted within the cavity, is chosen to yield a characteristic impedance of 50 ohms.

Figure 9:
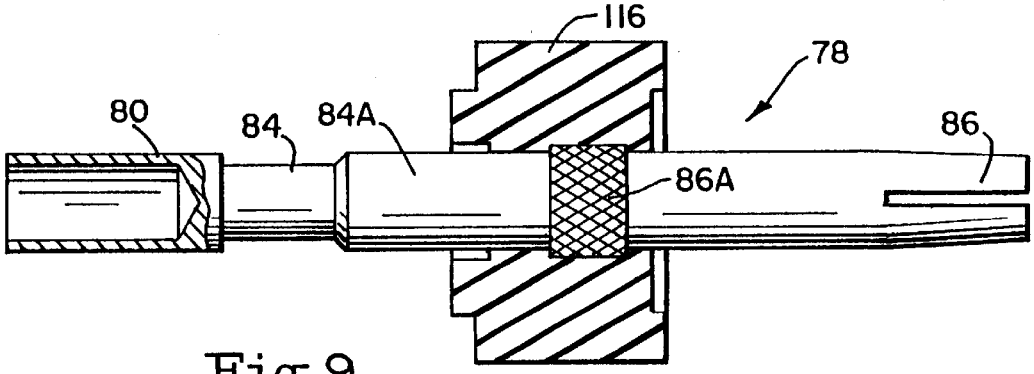
FIG. 9 illustrates the center contact and support element of a floating connector.

Referring specifically to FIG. 9 of the accompanying drawings, the center contact 78 of FIG. 8 is illustrated and described in greater detail. The left end as illustrated in FIG. 9 terminates in a hollow cylindrical sleeve 80 having an open end at its terminus. The hollow cylinder 80 receives the spring 82 and provides the guide surface for a cylindrical extension 81 of the plunger 74. The region 84 is followed to its right by a region 84A of increased diameter. The region 84 is provided, in conjunction with dimples 85 on the plunger to restrict movement of the plunger 74 and thus captivate it over t he center contact 78. Movement of the plunger 74 provides a desirable wiping contact over the region 84A.

The center contact 78 is supported in a dielectric bead 116 in turn supported in the connector body 70. The center contact 78 terminates at its right end as viewed in FIG. 9 in a split member 86 for connection to an external cable or the like with a corresponding male pin. Other configurations of contacts may be employed.

Referring to FIGS. 8B and 10, a ring shaped body 88 is to be press fitted into the connector body 101 of the connector 70 and is chamfered at its left end as indicated by reference numeral 103. The ring body 88 is assembled to the connector by being pushed into the connector, left to right, and has a knurled end region 81 to provide for easy retention in the body. The skirts 99A of spring fingers 83A ride up over the chamfer 103 and snap into place in a larger internal diameter region 105 beyond the chamfer on the ring shaped body 88.

In the configuration of FIG. 10, plunger 94 retreats into a hollow cylindrical sleeve 92 of center contact shaft 93 of connector 101. The change in outer diameter of the sleeve 92 of this embodiment is restricted to the left most region of the plunger adjacent to outer contact 96. Outer contact element 96 also moves, but its inner diameter at the left end region as illustrated in FIG. 10 does not change. Thus the changes in diameters occur at different axial locations and the SWR change from optimum is minimized as a function of axial movement of the two contacts. It will be noted that the body of the connectors in both FIGS. 8 and 10 do not move, only the contacts move. As indicated, this is an important feature of the invention.

The plunger contact 94 of the connector 101 is captivated/retained in the sleeve 92 by a small inward dimple 98 on the center contact which permits the plunger to slide, but prevents it from falling out. Again, the dimple does not contact the adjacent surface so as not to add drag to the movement of the contact.

Referring now to FIG. 10A, the planar contact surfaces between two connectors are surrounded by a metal shield 115. The shield is an integral part of the fixed planar connector 117, and is created by machining a large enough counterbore in the connector body so that now the mating takes place within the counterbore. The use of such a shield relieves the constraints on the mounting of the connectors in the modules and provides equally effective shielding. In this arrangement, planar contact surfaces 119 and 121 collectively, of the two connectors engage one another within the shield 115 minimizing electromagnetic radiation and cross talk.

Referring now to FIG. 11 of the accompanying drawings, there is presented a dual connector 136. An end 138 may be a fixed connector such as illustrated in FIGS. 5 and 6 while end 140 is a floating type such as the connector of FIG. 10.

Figure 12:
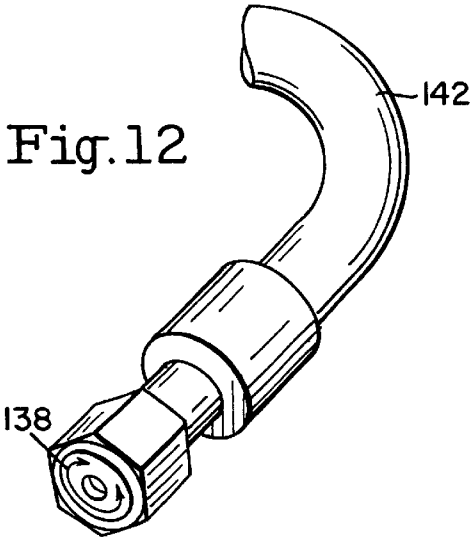
FIG. 12 illustrates a floating connector terminating in an antenna or any other transmission media through swivel joint of FIG. 13.

The end 138 or 140 of FIG. 11 may, as illustrated in FIG. 12, terminate in an element 142 that may be a microwave, or r.f. antenna, coaxial cable or other transmission media. In the event the member is an antenna, it may be desirable to permit rotation relative to the connector to be able to aim the antenna for maximum reception.

Figure 13:
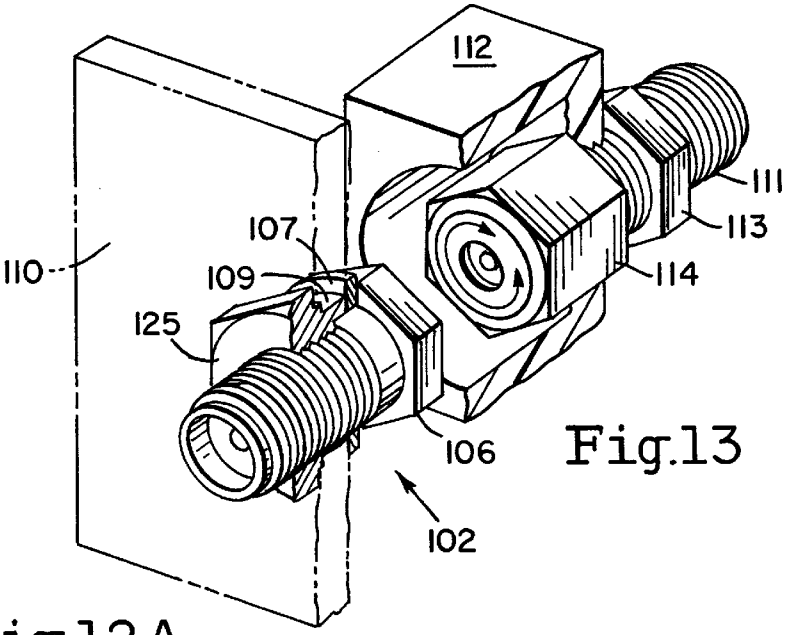
FIG. 13 illustrates an r.f. swivel/rotary joint for mounting an antenna that may be moved to change its orientation.
Figure 12A:
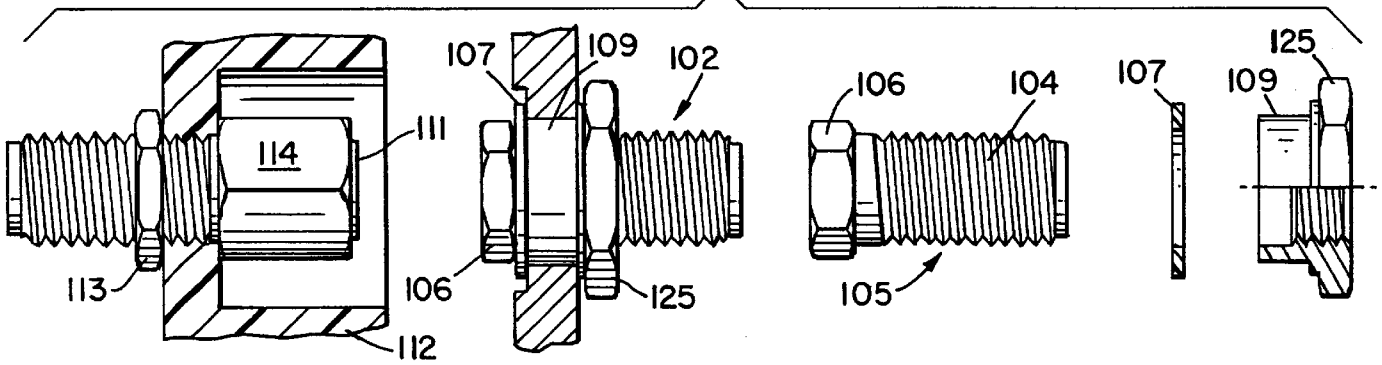
FIG. 12A illustrates the components of a swivel joint.

An example of an r.f swivel/rotary joint required to permit rotation of the antenna, cable, etc. is illustrated in FIGS. 12A and 13.

Referring specifically to FIGS. 12A and 13, there is illustrated a rotatable connector assembly 102 for use primarily with cables and the like to permit the connector to rotate with the cable to which it is connected. A bushing 125 is threaded to threaded region 104 of a planar blind-mate connector 105. A hex region 106 is located at the end of the connector body and a low friction washer 107 is disposed between the hex region 106 and the bushing 125.

The rotatable connector assembly is held in a wall, fixture, shield, etc. 110 which surrounds region 109 of the threaded bushing 125. The fit is snug, but permits rotation of the bushing, and thus of the connector, relative to the wall fixture 110.

The connector 102 is to mate with a floating blind-mate planar connector 111. The connector 111 is retained in a connector module 112 by a hex nut 113 and an integral hex nut 114. Although connector 111 is not rotatable in the module 112, the spring loaded inner and outer contacts within its body are free to rotate when the connector 102 is subjected to rotation and is engaged with connector 111. This result is indicated by the circular arrows on the interface of 111. As previously indicated, the use of threads is only one way of effecting connection as seen for instance in FIG. 8.

Figure 14:
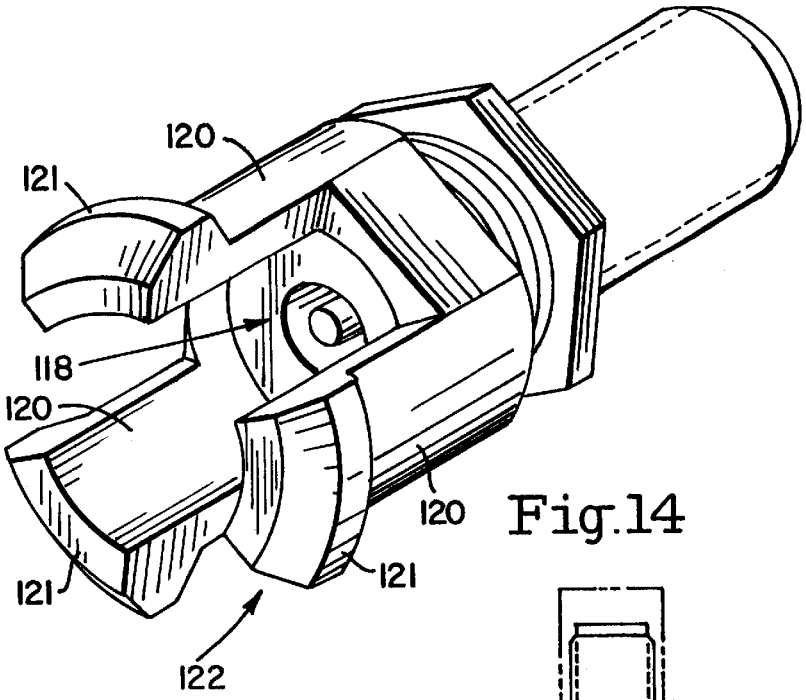
FIG. 14 illustrates a configuration providing a high degree of protection of a connector from r.f. interference, protection against broadcasting r.f. signals, and for physical protection.

Referring to FIG. 14 there is illustrated a highly shielded r.f. coupling region for use with the connector of the present invention. A connector generally designated by numeral 122 which may be of either type is deeply recessed in an extended region 118 of an elongated r.f. shield comprised of three, long spring fingers 120. Mating of the connectors occurs in a deep recess in the shield which greatly reduces leakage of the r.f. signal. The spring fingers have outwardly extending lips 121 that lock with receiving members associated with a mating connector.

Figure 15:
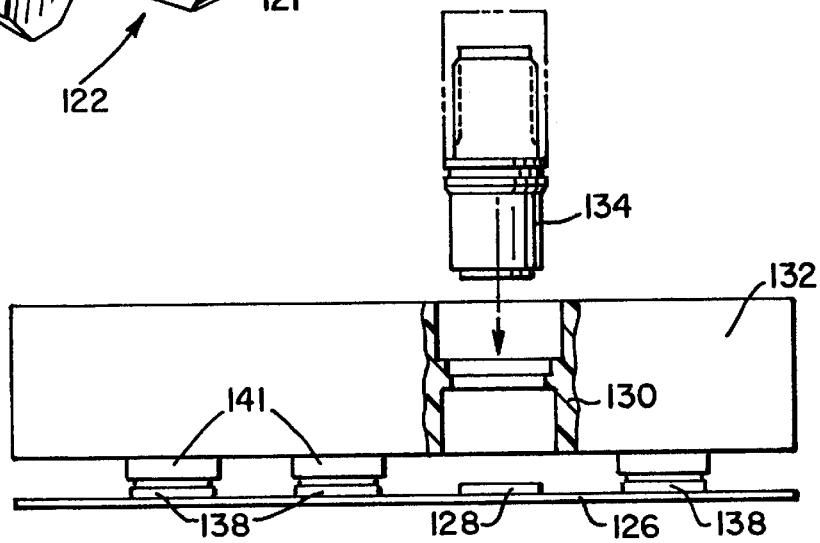
FIGS. 15 and 16 illustrate connection to and from, respectively, a circuit board.

Referring t o FIG. 15 of the drawings there is illustrated a connection to a printed circuit board from an antenna, a cable or the like. A printed circuit board 126 is provided with a fixed planar surface 128 that is appropriately connected to the printed circuit on the board 126. The surface 128 is not necessary since direct contact to the circuit on the board may be made. To connect to the board a connector cavity 130 is machined or molded into a connector housing 132 and accepts a floating planar blind-mate connector 134 to maintain contact with the surface 128. The connector 134 may be connected as illustrated in FIG. 12 to an antenna, cable or the like, reference numeral 142 in FIG. 12.

Numerous members 138, like surface 128, may be connected into the circuit on board 126 to permit take-off at various points of information processed by the circuit.

Figure 16:
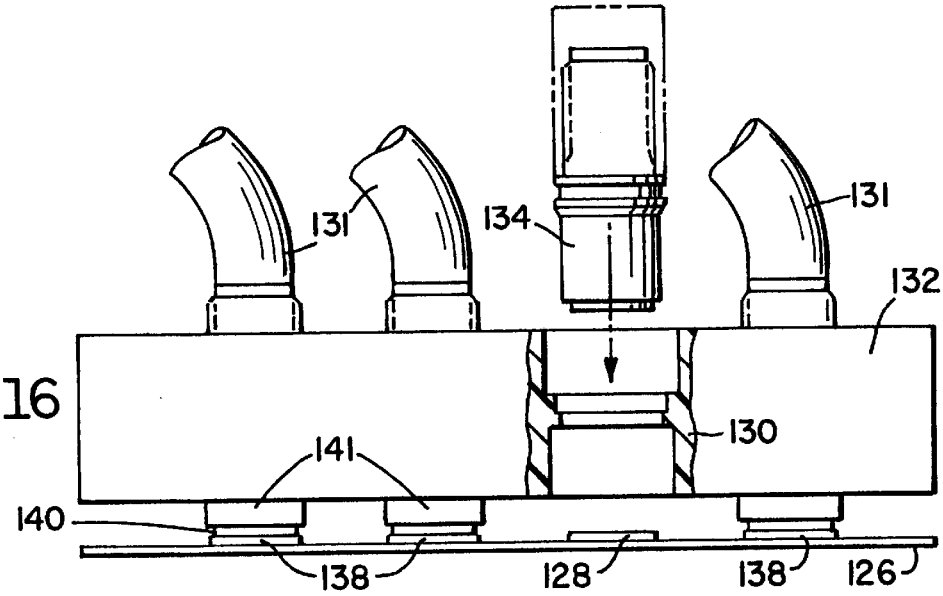

Referring to FIG. 16 and using the same reference numerals as in FIG. 15, floating planar blind-mate connectors 141, that are essentially the same as connector 134, take off processed signals from the printed circuit board 126 and distribute them, usually to distribution cables. The circuit board 126 may simply be used as a distribution center.

Figure 17:
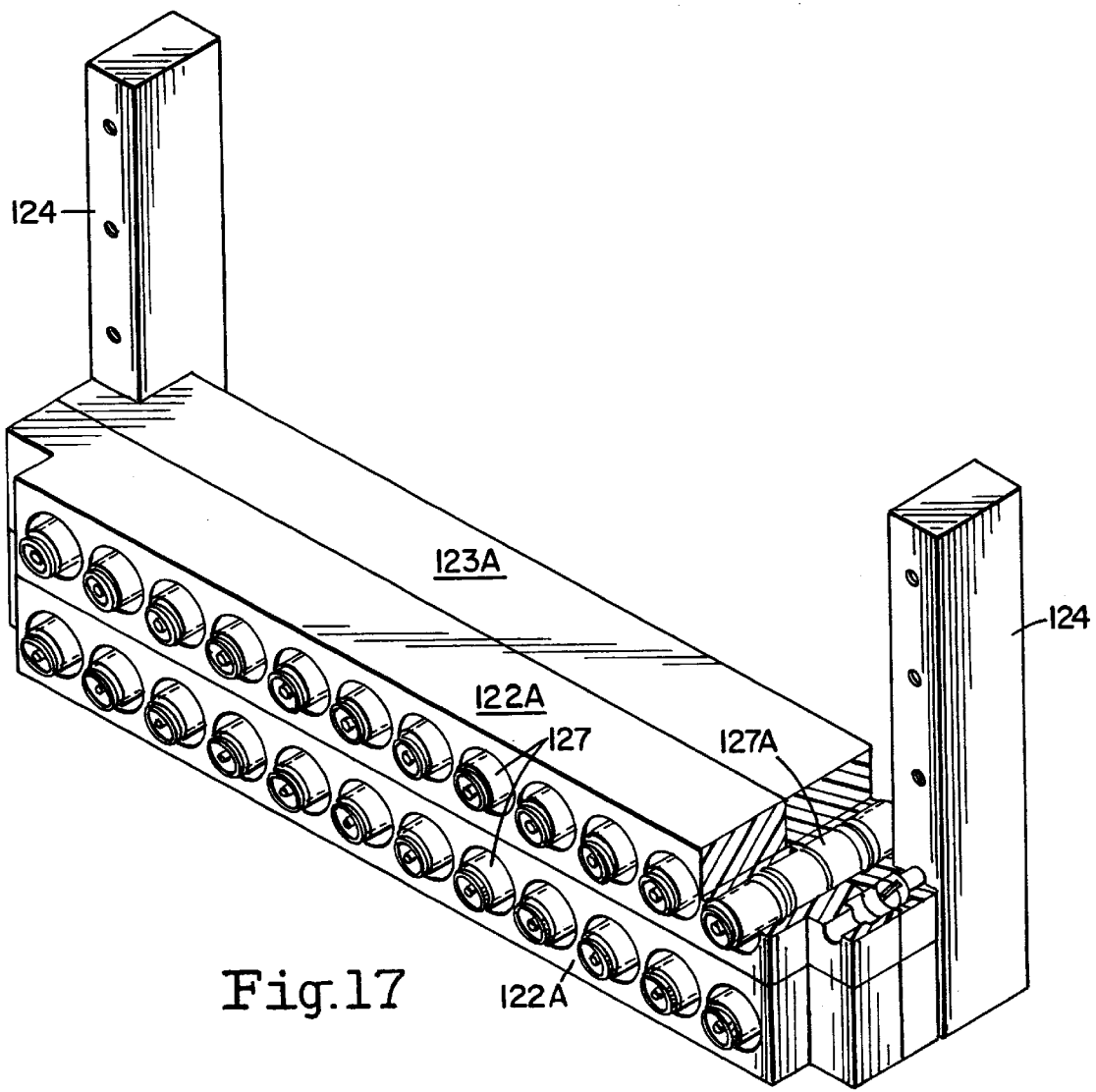
FIG. 17 illustrates a structure for providing a ganged assembly of connectors and connector modules.

The modules may be mounted in a mechanism that permits coupling of numerous floating and fixed component pairs concurrently. Mechanisms that permit such operation are available from several sources, such as Series 90 from the Virginia Panel Corporation and MacPanel Corporation Series 60-L2000. These series provide a selection of sizes for as many as five or ten to hundreds of connectors. The frames are configured externally to permit mounting in these mechanisms and reference to FIG. 17 is made to illustrate two modules for holding an array of connectors. Modules 122A are carried in a frame mechanism 124 for positioning the modules in a position wherein the connectors 127 in the module 122A are correctly aligned with the connectors in a corresponding frame. Connectors 127A of a module 123A are directly mounted in frame 124 and its connectors mate with those in module 122A to provide proper support for 122A as well as proper electrical connection.

There are three major features of the invention:

A first major feature is the long life of the connectors. These connectors outlast the pin and socket connectors by at least 10 times, with typically 100,000 mating cycles. Further, by recessing the contact surfaces, such as illustrated in FIGS. 10A, 11 and 11A, r.f leakage and cross-talk are virtually eliminated.

Another major feature is the tolerance of the apparatus. Pin and socket non-planar blind-mate connectors require a high alignment accuracy.

A third and equally important major feature is the fact that movement of the contacts of the connector is not conveyed to the connector body. The shaft 78 of FIG. 8 for instance is rigidly held in the connector body while the plunger slides on the shaft. In FIG. 10 the plunger 94A slides on rod 93. As to the outer contact of FIGS. 8 and 10, contact 72 slides on two surfaces, the inner surface of connector body 70, and the inner surface of member 88 of FIG. 8 and corresponding surfaces in FIG. 10.

The connector of the present invention does not require alignment accuracy to the same degree as the pin and socket type connectors. The use of planar contacting surfaces provides good electrical connections, even though precise alignment is not achieved. Further, the use of alignment pins, etc. insures that misalignment is always maintained within acceptable tolerance.

In the mass arrays of the present invention, such as illustrated in FIG. 4, the required strength of the modules is greatly reduced since only the force of the biasing springs must be accommodated, a force far less than the insertion force of pin and socket type blind-mate connectors.

It should be noted that the connectors of the present invention have a mating life of over 100,000 cycles as opposed to typically at a few thousand cycles for a pin and socket connector. Also in the embodiments employing rotating contacts, the life is extended as a result of rotation between smooth planar floating contact surfaces as opposed to pin and socket contacting surfaces with rigid ground planes.

Once given the above disclosure, many other features, modifications and improvements will become apparent to the skilled artisan. Such features modifications and improvements are, therefore, considered to be a part of this invention, the scope of which is to be determined by the claims.

What is claimed is:

1. Ganged planar face connectors comprising;

a first module, a first plurality of connector elements having planar face contact surfaces, said first plurality of connector elements arrayed in said first module, a second module, a second plurality of connector elements having planar face contact surfaces, said second plurality of connector elements arrayed in said second module in the same array as the said first plurality of connector elements in said first module, a slide located in one of said modules, said plurality of connector elements of said one of said modules located in said slide, said slide having a plurality of aligning holes, and a plurality of aligning pins situated on the other of said modules, said plurality of aligning pins positioned for entering said aligning holes and translating said slide to insure proper alignment of said pluralities of connector elements when said modules are mated, said first plurality of connectors of said first module contacting said second plurality of connectors of said second module on a one-for-one basis upon mating of said modules, thereby defining a plane of contact.

2. Ganged planar face connectors according to claim 1, further comprising:

a tack for said slide in said one of said modules, means for securing said slide in said track in said module, said means including threaded connectors, said slide having holes for receiving said threaded connectors, the other of said modules also having holes for receiving said threaded connectors, said threaded connectors being of lesser diameter than said holes in said slide to permit translation of said slide parallel to the said plane of contact of said connectors.

3. Ganged planar face connectors according to claim 2, wherein said threaded connectors are of a size to permit translation of said slide in a direction perpendicular to the said plane of contact between said modules.

4. A planar blind-mate connector comprising:

a first module having at least a first connector mounted upon a plate therein, a second module having mounted therein at least a second connector that mates with said first connector, both said first and second connectors having planar faces that contact one another upon mating of the said connectors, one of the said connectors having inner and outer contacts that are biased for movement in a direction toward the said planar face of the other said connector, means for bringing said first and second connectors into opposing alignment in their respective modules, said means comprising aligning pins protruding from one of said modules for insertion into aligning holes in said other module upon mating of said connector modules, said means further comprising a plate through which one said connector is disposed, said plate being mounted within one of said modules to slide along a plane parallel to its length, and means for changing the position of said plate in a direction perpendicular to said plane parallel to its length.

* * * * *